US009676192B2

(12) United States Patent
Chen et al.

(10) Patent No.: US 9,676,192 B2
(45) Date of Patent: Jun. 13, 2017

(54) PRINTBAR AND METHOD OF FORMING SAME

(71) Applicant: Hewlett-Packard Development Company, L.P., Houston, TX (US)

(72) Inventors: Chien-Hua Chen, Corvallis, OR (US); Michael W. Cumbie, Albany, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/021,522

(22) PCT Filed: Sep. 20, 2013

(86) PCT No.: PCT/US2013/060828

§ 371 (c)(1),
(2) Date: Mar. 11, 2016

(87) PCT Pub. No.: WO2015/041665

PCT Pub. Date: Mar. 26, 2015

(65) Prior Publication Data

US 2016/0221341 A1 Aug. 4, 2016

(51) Int. Cl.

| | |
|---|---|
| ***B41J 2/14*** | (2006.01) |
| ***B41J 2/16*** | (2006.01) |
| ***B41J 2/155*** | (2006.01) |

(52) U.S. Cl.

CPC ..... *B41J 2/1637* (2013.01); *B41J 2/1433* (2013.01); *B41J 2/155* (2013.01); *B41J 2/1601* (2013.01); *B41J 2/162* (2013.01); *B41J 2/1607* (2013.01); *B41J 2/1628* (2013.01); *B41J 2/1632* (2013.01);
(Continued)

(58) Field of Classification Search

CPC .... B41J 2/1637; B41J 2/1433; B41J 2/14016; B41J 2/14; B41J 2002/14419

See application file for complete search history.

(56) References Cited

U.S. PATENT DOCUMENTS

| | | | |
|---|---|---|---|
| 5,912,686 | A | 6/1999 | Palmer et al. |
| 6,435,653 | B1 | 8/2002 | Boyd et al. |
| 6,648,437 | B2 | 11/2003 | Kawamura et al. |

(Continued)

FOREIGN PATENT DOCUMENTS

| | | |
|---|---|---|
| CN | 102574395 | 7/2012 |
| WO | WO2014/133561 | 9/2014 |
| WO | WO2014/133633 | 9/2014 |

OTHER PUBLICATIONS

Lee et al; A Thermal Inkjet Printhead with a Monolithically Fabricated Nozzle Plate and Self-aligned Ink Feed Hole; Jrnl of Microelectromechanical Sys., vol. 8 No. 3, 1999.

(Continued)

*Primary Examiner* — Geoffrey Mruk

(74) *Attorney, Agent, or Firm* — HP Inc.—Patent Department

(57) ABSTRACT

A printbar module and method of forming the same are described. In an example, a printbar module includes a printed circuit board (PCB), a plurality of printhead die slivers, and a manifold. The printhead die slivers are embedded in molding and attached to the PCB. The molding has a plurality of slots in fluidic communication with fluid feed holes of the printhead die slivers. The manifold is in direct fluidic communication with the slots to supply fluid thereto.

14 Claims, 11 Drawing Sheets

(52) U.S. Cl.
CPC .. *B41J 2002/14419* (2013.01); *B41J 2202/19* (2013.01)

(56) References Cited

U.S. PATENT DOCUMENTS

| | | | | |
|---|---|---|---|---|
| 7,566,122 | B2 | 7/2009 | Gibson et al. | |
| 8,438,730 | B2 | 5/2013 | Ciminelli | |
| 8,444,252 | B2 | 5/2013 | Keshishian et al. | |
| 2003/0052944 | A1* | 3/2003 | Scheffelin | B41J 2/14024 347/49 |
| 2004/0046939 | A1 | 3/2004 | Nakamura et al. | |
| 2006/0290755 | A1 | 12/2006 | Lee | |
| 2007/0146441 | A1 | 6/2007 | Miyasaka et al. | |
| 2010/0149257 | A1 | 6/2010 | Lee et al. | |
| 2011/0037808 | A1* | 2/2011 | Ciminelli | B41J 2/14072 347/50 |
| 2012/0013682 | A1 | 1/2012 | Chida et al. | |
| 2012/0133710 | A1* | 5/2012 | Joyner, II | B41J 2/1603 347/61 |

OTHER PUBLICATIONS

International Search Report and Written Opinion for International Application No. PCT/US2013/060828 dated Jun. 12, 2014, 11 pages.

* cited by examiner

PRINTBAR AND METHOD OF FORMING SAME

BACKGROUND

Each printhead die in an inkjet pen or print bar includes tiny channels that carry ink to the ejection chambers. Ink is distributed from the ink supply to the die channels through passages in a structure that supports the printhead die(s) on the pen or print bar. It may be desirable to shrink the size of each printhead die, for example to reduce the cost of the die and, accordingly, to reduce the cost of the pen or print bar. The use of smaller dies, however, can require changes to the larger structures that support the dies, including the passages that distribute ink to the dies.

BRIEF DESCRIPTION OF THE DRAWINGS

Some embodiments of the invention are described with respect to the following figures.

DETAILED DESCRIPTION

Figure 1:
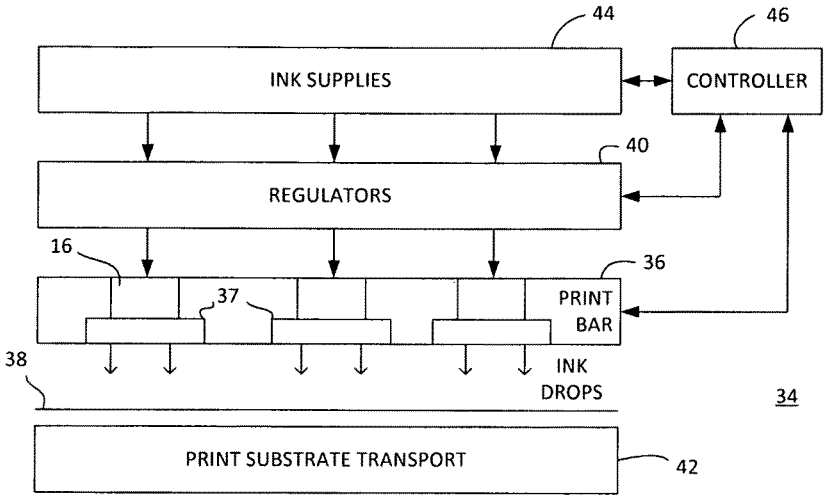
FIG. 1 is a block diagram illustrating an inkjet printer implementing one example of a new fluid flow structure in a substrate wide print bar according to an example implementation.

FIG. 1 is a block diagram illustrating an inkjet printer 34 implementing one example of a new fluid flow structure in a substrate wide print bar 36 according to an example implementation. Referring to FIG. 1, the printer 34 includes a print bar 36 spanning the width of a print substrate 38, flow regulators 40 associated with the print bar 36, a substrate transport mechanism 42, ink or other printing fluid supplies 44, and a printer controller 46. The Controller 46 represents the programming, processor(s) and associated memories, and the electronic circuitry and components needed to control the operative elements of the printer 34. The print bar 36 includes an arrangement of printheads 37 for dispensing printing fluid on to a sheet or continuous web of paper or other print substrate 38. As described in detail below, each printhead 37 includes one or more printhead dies in a molding with channels 16 to feed printing fluid directly to the die(s). Each printhead die receives printing fluid through a flow path from the supplies 44 into and through the flow regulators 40 and the channels 16 in print bar 36. Notably, as described below, the print bar 36 does not require fluidic fan-out component between the printheads 37 and the fluid supply.

Figure 11:
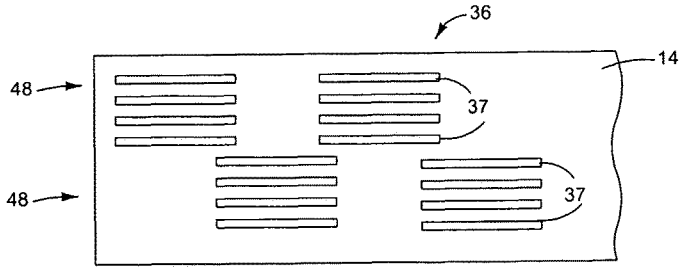

FIGS. 2-7 illustrate an inkjet print bar 36 implementing one example of a new fluid flow structure, such as might be used in printer 34 shown in FIG. 1, according to an example implementation. Referring first to the plan view of FIG. 2, printheads 37 are embedded in an elongated, monolithic molding 14 and arranged generally end to end in rows 48 in a staggered configuration in which the printheads in each row overlap another printhead in that row. Although four rows 48 of staggered printheads 37 are shown, for printing four different colors for example, other suitable configurations are possible. For example, FIG. 11 shows a plan view of an inkjet print bar 36 having staggered groups of printheads 37 embedded in an elongated, monolithic molding 14. Each of the groups includes four printheads 37 by way of example, although a group can have more or less printheads.

Figure 2:
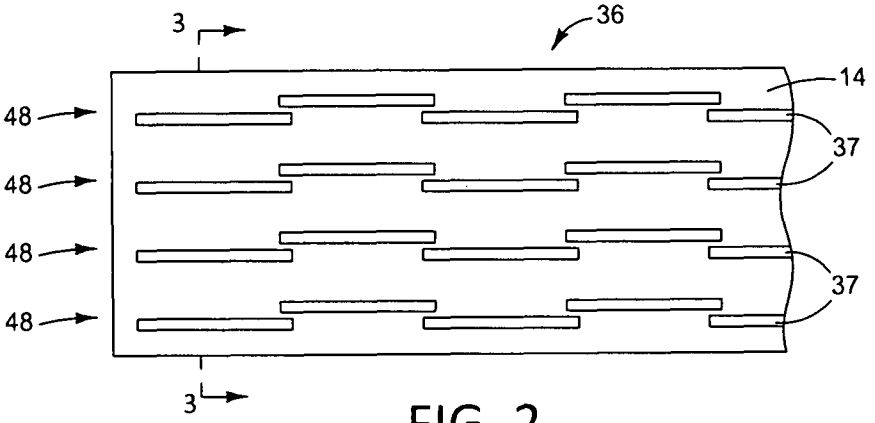
FIGS. 2-7 and 11 illustrate an inkjet print bar implementing one example of a new fluid flow structure, such as might be used in printer shown in FIG. 1, according to an example implementation.
Figure 3:
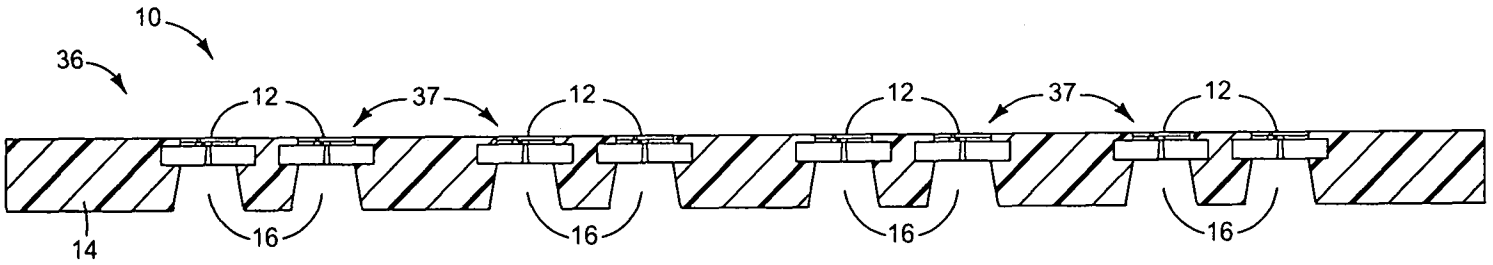
Figure 4:
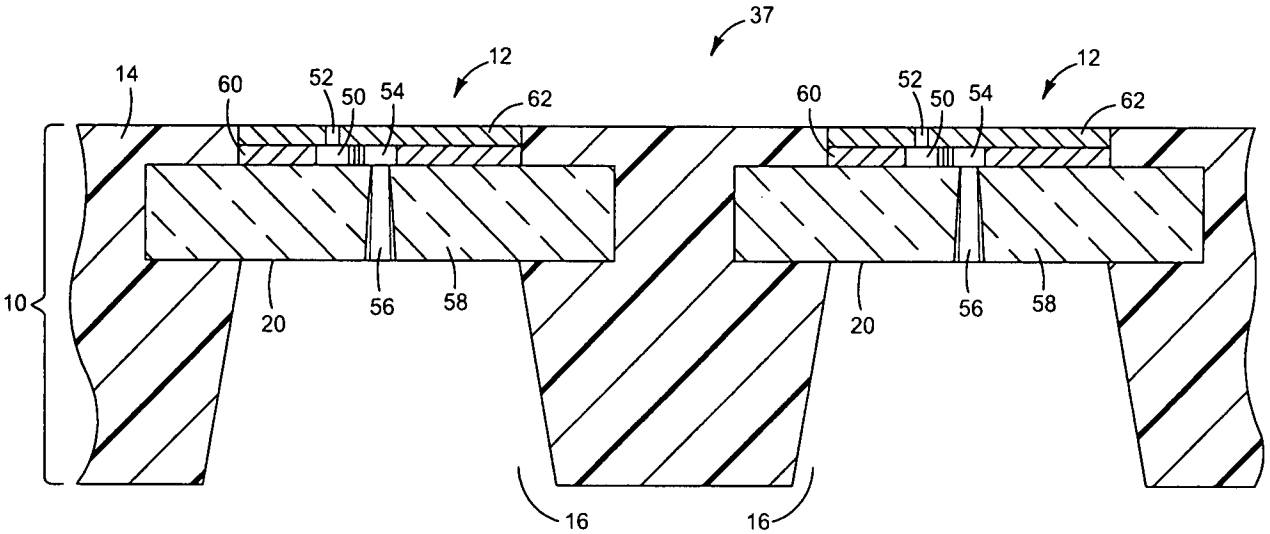
Figure 5:
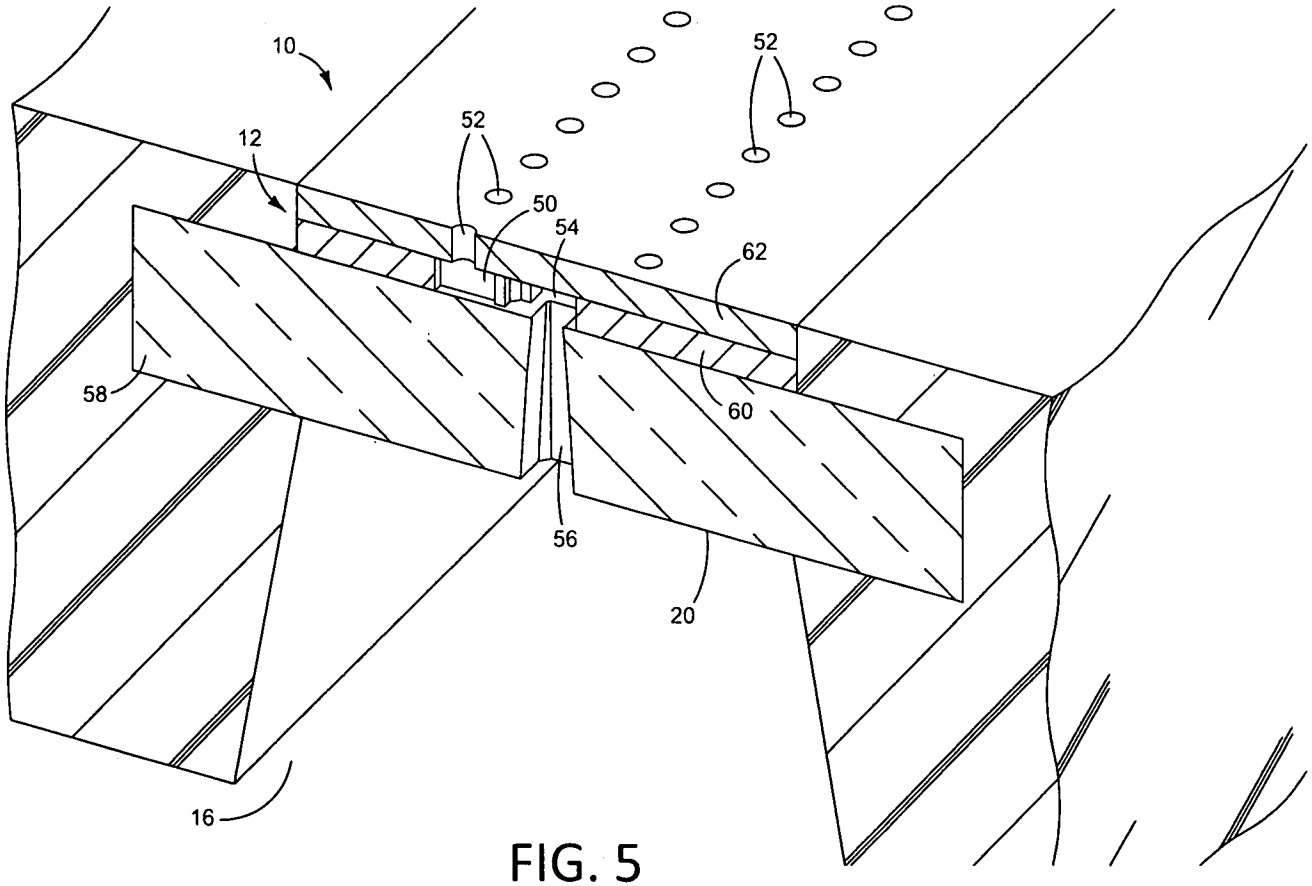
Figure 6:
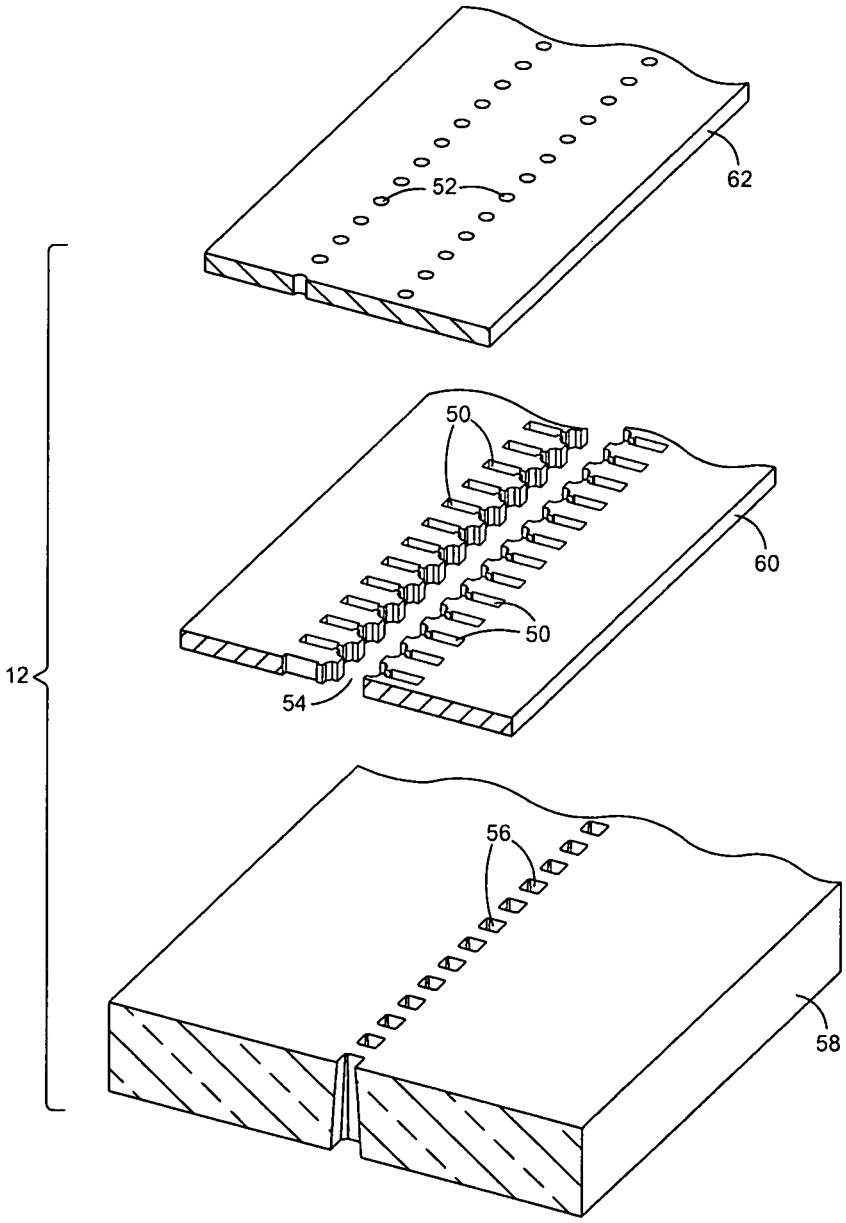
Figure 7:
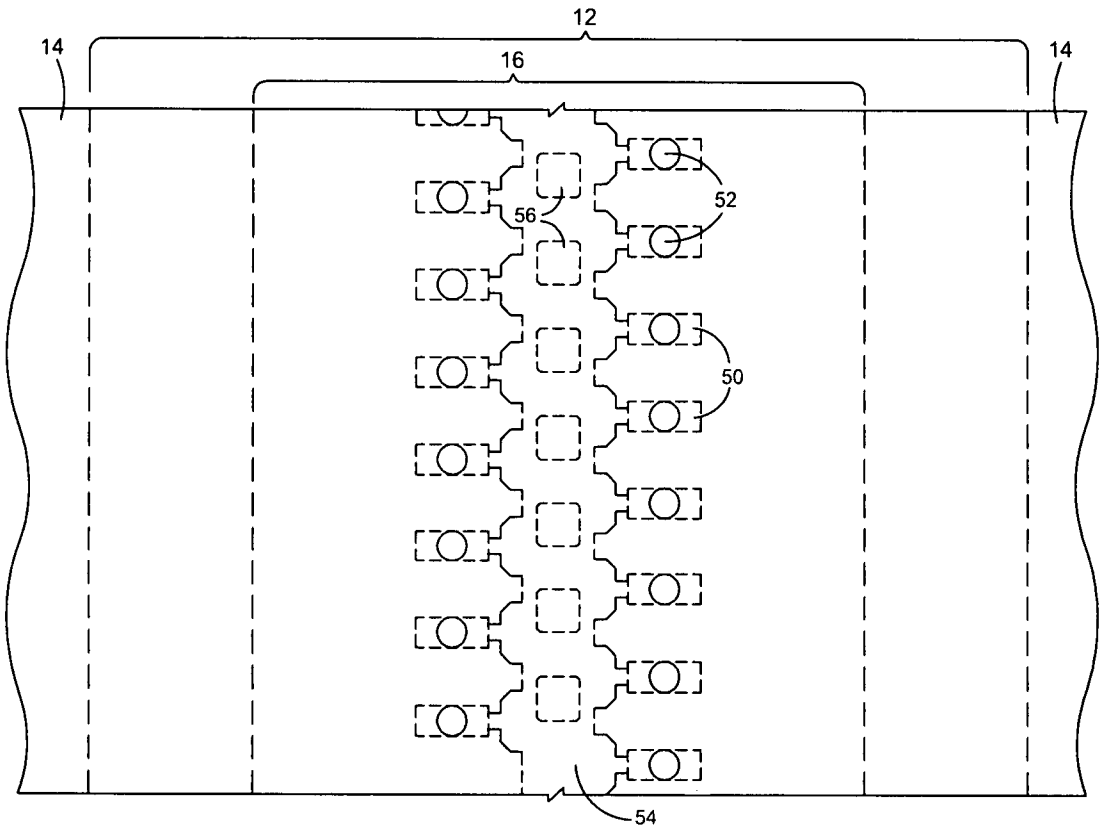

FIG. 3 is a section view taken along the line 3-3 in FIG. 2. FIGS. 4-6 are detail views from FIG. 3, and FIG. 7 is a plan view diagram showing the layout of some of the features of printhead die flow structure in FIGS. 3-5. Referring now to FIGS. 2-6, in the example shown, each printhead 37 includes a pair of printhead dies 12 each with two rows of ejection chambers 50 and corresponding orifices 52 through which printing fluid is ejected from chambers 50. Each channel 16 in molding 14 supplies printing fluid to one printhead die 12. Other suitable configurations for printhead 37 are possible. For example, more or fewer printhead dies 12 may be used with more or fewer ejection chambers 50 and channels 16. (Although print bar 36 and printheads 37 face up in FIGS. 3-6, print bar 36 and printheads 37 usually face down when installed in a printer, as depicted in the block diagram of FIG. 1.)

Printing fluid flows into each ejection chamber 50 from a manifold 54 extending lengthwise along each die 12 between the two rows of ejection chambers 50. Printing fluid feeds into manifold 54 through multiple ports 56 that are connected to a printing fluid supply channel 16 at die surface 20. Printing fluid supply channel 16 is substantially wider than printing fluid ports 56, as shown, to carry printing fluid from larger, loosely spaced passages in the flow regulator or other parts that carry printing fluid into print bar 36 to the smaller, tightly spaced printing fluid ports 56 in printhead die 12. Thus, printing fluid supply channels 16 can help reduce or even eliminate the need for a discrete "fan-out" and other fluid routing structures necessary in some conventional printheads. In addition, exposing a substantial area of printhead die surface 20 directly to channel 16, as shown, allows printing fluid in channel 16 to help cool die 12 during printing.

The idealized representation of a printhead die 12 in FIGS. 2-6 depicts three layers 58, 60, 62 for convenience only to clearly show ejection chambers 50, orifices 52, manifold 54, and ports 56. An actual inkjet printhead die 12 is a typically complex integrated circuit (IC) structure formed on a silicon substrate 58 with layers and elements not shown in FIGS. 2-6. For example, a thermal ejector element or a piezoelectric ejector element formed on substrate 58 at each ejection chamber 50 is actuated to eject drops or streams of ink or other printing fluid from orifices 52. While the present disclosures describes "ink" by way of example, it is to be understood that in general "fluid" can be used in place of "ink" wherever "ink" is specifically recited.

A molded flow structure 10 enables the use of long, narrow and very thin printhead dies 12 (also referred to herein as "printhead die slivers", "die slivers", or "slivers"). For example, it has been shown that a 100 μm thick printhead die 12 that is about 26 mm long and 500 μm wide can be molded into a 500 μm thick body 14 to replace a conventional 500 μm thick silicon printhead die. Not only is it cheaper and easier to mold channels 16 into body 14 compared to forming the feed channels in a silicon substrate, but it is also cheaper and easier to form printing fluid ports 56 in a thinner die 12. As an alternative, a laser or plunge cut saw can be used to create ink channels in molded panels. For example, ports 56 in a 100 μm thick printhead die 12 may be formed by dry etching and other suitable micromachining techniques not practical for thicker substrates. Micromachining a high density array of straight or slightly tapered through ports 56 in a thin silicon, glass or other substrate 58 rather than forming conventional slots leaves a stronger substrate while still providing adequate printing fluid flow. Tapered ports 56 help move air bubbles away from manifold 54 and ejection chambers 50 formed, for example, in a monolithic or multi-layered orifice plate 60/62 applied to substrate 58. It is expected that current die handling equipment and micro device molding tools and techniques can adapted to mold dies 12 as thin as 50 μm, with a length/width ratio up to 150, and to mold channels 16 as narrow as 30 μm. And, the molding 14 provides an effective but inexpensive structure in which multiple rows of such die slivers can be supported in a single, monolithic body.

In an example, a width of each die sliver 12 is substantially narrower than a spacing between die slivers 12. Further, the thickness of each die sliver 12 can be substantially thinner than a thickness of the monolithic molding 14. In a non-limiting example, each die sliver 12 is less than or equal to 300 micrometers. It is to be understood that the die slivers 12 can have other thickness more than 300 micrometers.

Figure 8:
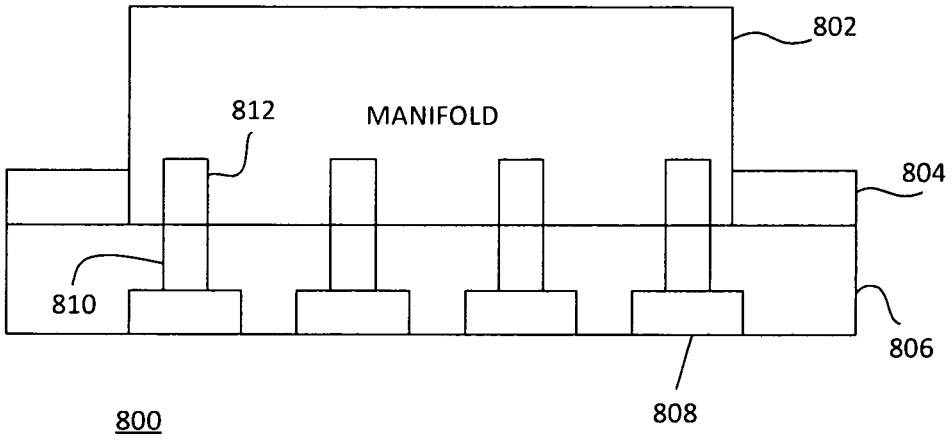
FIG. 8 is a block diagram of a printbar module according to an example implementation.

FIG. 8 is a block diagram of a printbar module 800 according to an example implementation. The printbar module 800 includes a support structure 804 supporting a manifold 802 and a printed circuit board (PCB) 806. The manifold 802 has an ink delivery interface having a plurality of ink passages 812. The PCB 806 includes printhead die slivers 808 (e.g., four are shown) that fludically communicate with the manifold 802 through slots 810. In addition to supporting the printhead die slivers 808, the PCB 806 can include electrical circuitry and/or routing coupled to the printhead die slivers 808. In an example, each of the die slivers 808 is co-planar with a top surface of the PCB 806. As shown and described above, each printhead die sliver 808 has an ink feed slot 810 for receiving ink directly from the manifold 802. When assembled as part of the printbar module 800, the printhead die slivers 808 are not part of a single semiconductor substrate, but rather are formed from separate semiconductor substrates (note that the slivers can be formed on a single substrate or wafer and then singulated during manufacture to be assembled on the printbar module 800). The separate printhead die slivers 808 can be positioned to provide an appropriate ink slot pitch that cooperates with the manifold 802 to receive the ink. Notably, a separate fluidic fanout structure is not required between the manifold 802 and the printhead die slivers 808. An example process for forming the printhead die 808 slivers is described below. The term "printbar module" as used herein is meant to encompass various print structures, such as page-wide modules, integrated printhead/containers, individual ink cartridges, and the like.

Figure 9A:
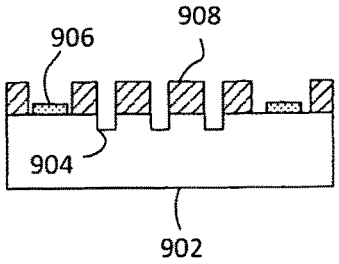
FIGS. 9 and 10 show a process for forming a printbar module according to an example implementation.
Figure 9B:
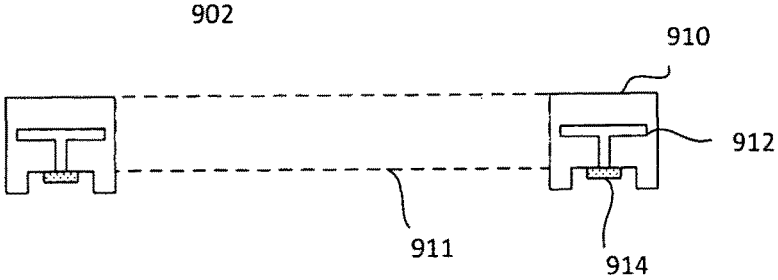
Figure 9C:
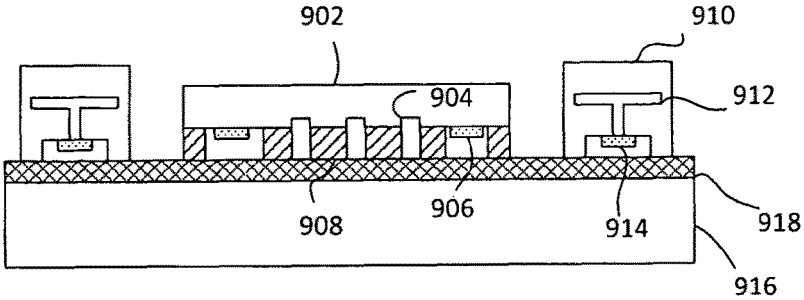
Figure 9D:
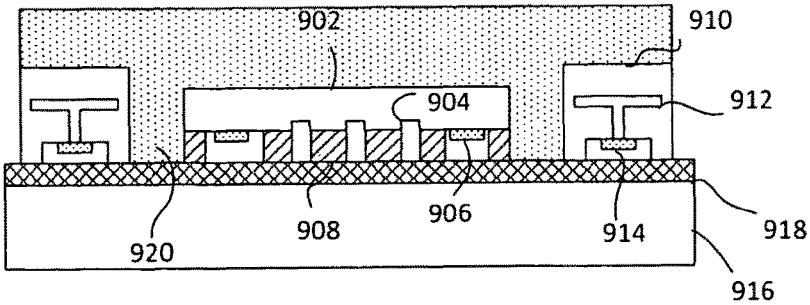
Figure 9E:
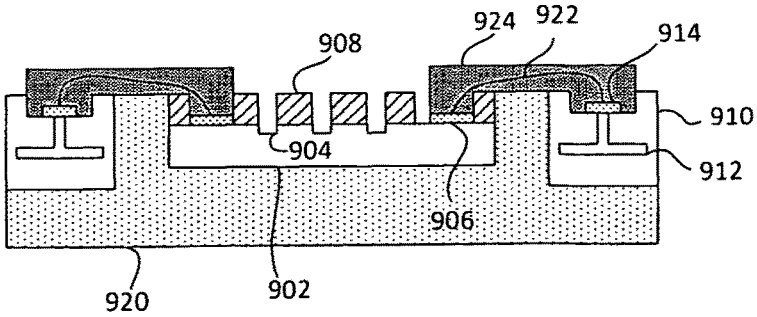
Figure 9F:
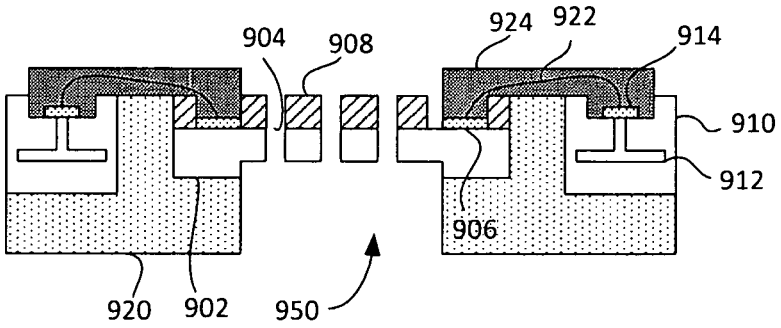
Figure 10:
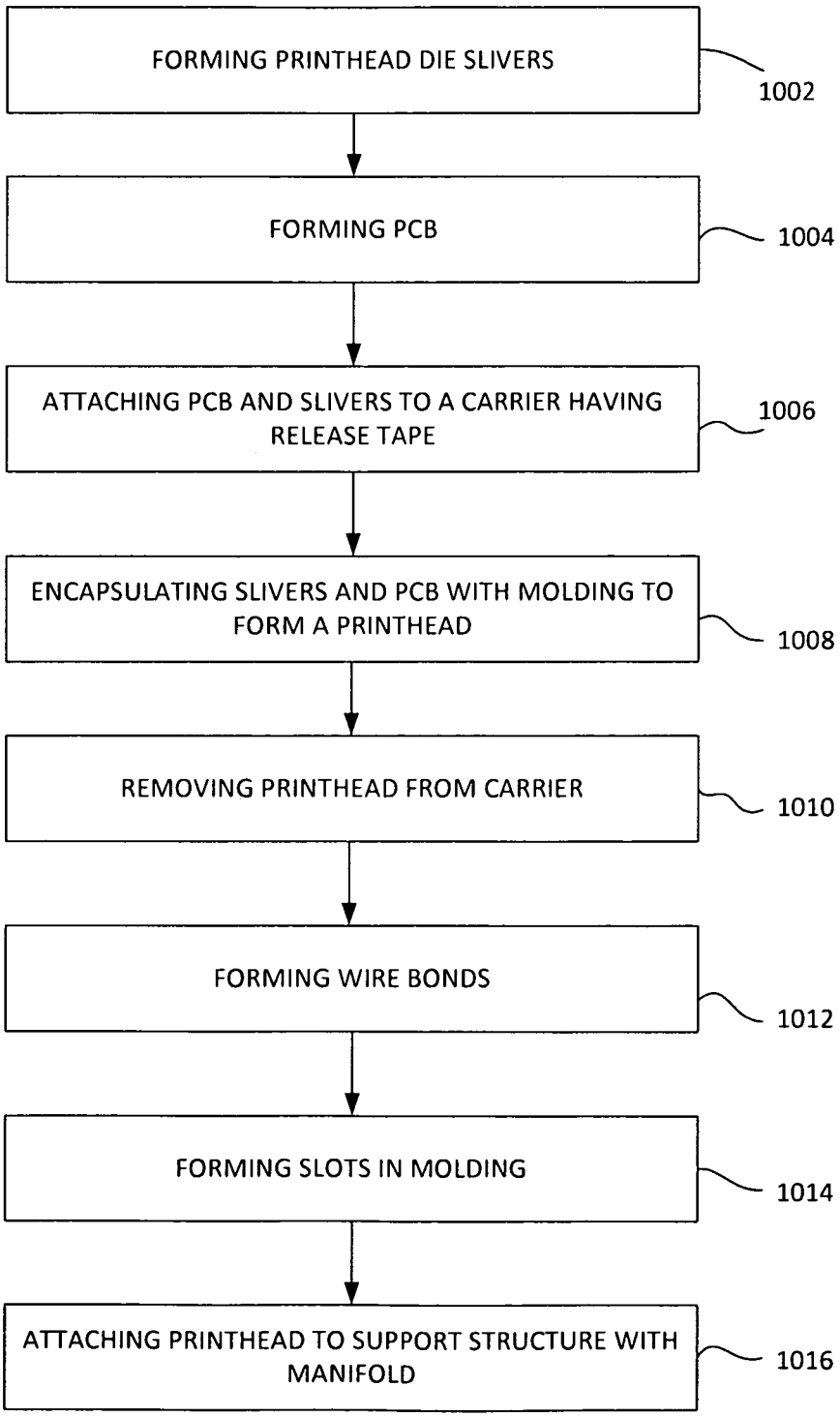

FIGS. 9 and 10 show a process for forming a printbar module according to an example implementation. FIGS. 9A through 9F show cross-sections of the module after various steps, while FIG. 10 shows a flow diagram of a process 1000 for forming a printbar module. At step 1002, printhead die .slivers are formed. As shown in FIG. 9A, a printhead die sliver 902 includes ink feed holes 904, thin-film layer 908 (including firing chambers), and conductors 906. The ink feed holes 904 are configured to provide ink to fluid ejectors formed in the thin-film layer 908. The printhead die sliver 902 comprises semiconductor material (e.g., silicon) and can include integrated circuitry (e.g., transistors, resistors, etc.).

At step 1004, a PCB is formed. As shown in FIG. 9B, a PCB 910 includes conductive routing 912 and conductive pads 914. The PCB 910 also includes areas 911 (also referred to as windows) into which the printhead die slivers 902 will fit.

At step 1006, the PCB and printhead die slivers are attached to a carrier having release tape 918. As shown in FIG. 9C, a carrier 916 having release tape 918 supports the PCB 910 and a printhead die sliver 902.

At step 1008, the printhead die slivers and PCB are encapsulated in a molding. In an example, the molding can be a monolithic molding compound. As shown in FIG. 9D, molding 920 encapsulates the PCB 910 and a printhead die sliver 902.

At step 1010, the printhead is removed from the carrier. At step 1012, wire bonds are formed between the printhead die slivers and the PCB 910. As shown in FIG. 9E, wire bonds 922 are formed between conductive pads 906 and 914. The wire bonds 922 can be encapsulated in protective film 924.

At step 1012, slots are formed in the molding. As shown in FIG. 9F, a slot 950 is formed in the molding 920 in fluidic communication with the ink feed hole. The slot can be formed using various techniques, such as laser etching, plunge-cut saw, and the like. At step 1014, the printhead is attached to a structure having a manifold, as shown above in FIG. 8.

In the foregoing description, numerous details are set forth to provide an understanding of the present invention. However, it will be understood by those skilled in the art that the present invention may be practiced without these details. While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A printbar module, comprising:

a printed circuit board (PCB);

a plurality of printhead die slivers positioned in a window of the PCB and embedded in a molding attached to the PCB, each printhead die sliver having a plurality of fluid feed holes and the molding having a plurality of slots in direct fluidic communication with the fluid feed holes; and a manifold in direct fluidic communication with the plurality of slots to supply fluid thereto.

2. The printbar module of claim 1, wherein the plurality of slots are formed in the molding such that a slot pitch thereof matches a fluid delivery interface of the manifold to provide the direct fluidic communication without fanout.

3. The printbar module of claim 1, wherein a width of each of the plurality of printhead die slivers is substantially narrower than a spacing between the plurality of printhead die slivers.

4. The printbar module of claim 1, wherein a thickness of each of the plurality of printhead die slivers is substantially thinner than a thickness of the molding.

5. The printbar module of claim 4, wherein the thickness of each of the plurality of printhead die slivers is less than or equal to 300 micrometers.

6. The printbar module of claim 1, wherein top surfaces of the plurality of printhead die slivers are co-planar with a top surface of the PCB.

7. The printbar module of claim 1, further comprising:

wire bonds electrically coupling conductive elements of the PCB to conductive elements of at least one of the printhead die slivers.

8. The printbar module of claim 1, wherein the molding comprises a monolithic molding.

9. A printbar structure, comprising:

a printed circuit board (PCB);

multiple printhead die slivers;

multiple ink feed holes in each die sliver;

a molding encapsulating the die slivers and the printed circuit board such that each die sliver is positioned in a window in the PCB surrounded by molding; and multiple slots in the molding, each slot in direct fluidic communication with multiple ink feed holes.

10. The printbar structure of claim 9, further comprising wire bonds electrically coupling conductive elements of the PCB to conductive elements of the die slivers.

11. The printbar structure of claim 10, further comprising a protective film encapsulating the wire bonds.

12. The printbar structure of claim 11, further comprising:

a manifold; and fluid passages in the manifold in direct fluidic communication with the slots.

13. The printbar structure of claim 12, wherein the molding is a monolithic molding.

14. A printbar structure, comprising:

a printed circuit board (PCB);

multiple printhead die slivers;

a carrier releasably carrying the PCB with release tape and releasably carrying each die sliver with the release tape in a window in the PCB; and a molding encapsulating the PCB and die slivers.

* * * * *